US011859393B2

(12) United States Patent
Chen et al.

(10) Patent No.: US 11,859,393 B2
(45) Date of Patent: Jan. 2, 2024

(54) RAISED FLOOR SYSTEM FOR SUSPENSION TYPE PIPELINES

(71) Applicants: Yao-Chung Chen, New Taipei (TW); Shih-Jan Wang, Taipei (TW)

(72) Inventors: Yao-Chung Chen, New Taipei (TW); Shih-Jan Wang, Taipei (TW)

( * ) Notice: Subject to any disclaimer, the term of this patent is extended or adjusted under 35 U.S.C. 154(b) by 148 days.

(21) Appl. No.: 17/499,347

(22) Filed: Oct. 12, 2021

(65) Prior Publication Data

US 2023/0071860 A1 Mar. 9, 2023

(30) Foreign Application Priority Data

Sep. 7, 2021 (TW) ..... 110210561

(51) Int. Cl.
*E04F 15/024* (2006.01)

(52) U.S. Cl.
CPC .... *E04F 15/02447* (2013.01); *E04F 2290/02* (2013.01)

(58) Field of Classification Search
CPC ..... E04F 15/024; E04F 15/02411; E04F 15/02447; E04F 15/02452; E04F 15/02458; E04F 15/02464; E04F 15/0247; E04F 15/02494; E04F 2290/02; E04F 17/08; E04C 2/521; H02G 3/22; H02G 3/28; H02G 3/30; H02F 3/36
USPC ..... 52/220.1, 220.3, 220.5, 220.7
See application file for complete search history.

(56) References Cited

U.S. PATENT DOCUMENTS

| | | | | | |
|---|---|---|---|---|---|
| RE33,220 | E * | 5/1990 | Collier | E04F 15/02452 | 52/263 |
| 5,477,649 | A * | 12/1995 | Bessert | H02G 3/285 | 52/126.2 |
| 5,953,870 | A * | 9/1999 | Jette | H02G 3/285 | 52/126.2 |
| 6,347,493 | B1 * | 2/2002 | Jette | H02G 3/285 | 52/126.2 |
| 6,427,400 | B1 * | 8/2002 | Greenblatt | H02G 3/0443 | 52/126.2 |
| 7,462,785 | B1 * | 12/2008 | Davis | H02G 3/0443 | 403/329 |
| 2009/0090073 | A1 * | 4/2009 | Bravo | E04F 15/0247 | 52/220.1 |
| 2020/0389004 | A1 * | 12/2020 | Chen | H02G 3/385 | |

* cited by examiner

*Primary Examiner* — William V Gilbert
(74) *Attorney, Agent, or Firm* — Muncy, Geissler, Olds & Lowe, P.C.

(57) ABSTRACT

A raised floor system for suspension type pipelines mainly comprises girders and floor units laid between foot stands after the foot stands are erected at intervals on the floor, such that floor units are separated from the floor by a distance to form a large-area raised floor, wherein a top portion of each foot stand for the floor units to be placed thereon is combined with a cover, of four sides of the cover each is vertically provided with a folded plate, a hole is formed on the folded plate, two ends of a suspension device are capable of being respectively hooked on the holes of the folded plates of two of the spaced foot stands, so that the suspension device is placed under the floor units for pipelines to be placed thereon or fixed thereto.

8 Claims, 5 Drawing Sheets

RAISED FLOOR SYSTEM FOR SUSPENSION TYPE PIPELINES

FIELD OF THE INVENTION

The present invention is related to a raised floor system for suspension type pipelines with simple structure, easy assembly, low cost, that can be used for diverting various kinds of pipelines, such as electrical wires, signal lines, water pipes or air-conditioning ducts.

BACKGROUND OF THE INVENTION

For workplaces where the use of computers is widespread, the wiring of the network and other lines is very important and necessary. Since each computer must be connected to or powered on with other computers through the network, when the amount of equipments is large, the situation of line staggering becomes more complicated. If lines are exposed to the outside, it will be unsightly and will affect the movement of people. The network floor can be erected to keep space for threading and patching at the bottom, and the number of floors to be laid can be flexibly determined according to the size of the indoor space. Therefore, it has become the mainstream of modern informationalized office.

In the above-mentioned raised floor design, because the pipelines are hidden under the raised floor, there is no shunt design; that is, all pipelines such as power lines, telephone lines, network cables and other power or signal cables are mixed together; especially in under-floor air conditioning (UFAD) popular countries (such as the United States and Canada) additional larger pipelines, such as condensers, hot water pipes, water pipes of gas pipes are placed under the raised floor, making the pipelines under the raised floor more chaotic. For various pipelines or the construction staff for pipelines, the installation, maintenance and even removal thereof have caused great trouble and inconvenience in operation.

SUMMARY OF THE INVENTION

In view of the above disadvantages, how to solve the existing problems and to provide a more effective diversion, multi-functional, expandable wires and pipelines suspension system, and achieve faster construction and reduce overall costs, has always been the research direction of the inventor of present invention.

The main object of the present invention is to provide a raised floor system for suspension type pipelines with simple structure, easy assembly, low cost, that can be used for diverting various kinds of pipelines, such as electrical wires, signal lines, water pipes or air-conditioning ducts.

In order to achieve the above object, the present invention provides a raised floor system for suspension type pipelines, which mainly comprises girders and floor units laid between pluralities of foot stands after the foot stands are erected at intervals on the floor, such that the floor units are separated from the floor by a distance so as to form a large-area raised floor, wherein a top portion of the foot stand for the floor units to be placed thereon is combined with a cover, of four sides of the cover each is vertically provided with a folded plate, a hole is formed on the folded plate, two ends of a suspension device are capable of being respectively hooked on the holes of the folded plates of two of the spaced foot stands, so that the suspension device is placed under the floor units for pipelines to be placed thereon or fixed thereto.

In implementation, the suspension device comprises two hook plates and an inverted U-shaped cantilever beam, the hook plate is Z-shaped, an upper top face and a lower top face are formed on two ends of the hook plate, wherein the upper top face is used for passing through the hole of the folded plate, the lower top face is used for supporting one end of the cantilever beam so that the suspension device is capable of being positioned between two of the foot stands.

In implementation, at least one separation column is further provided on the cantilever beam for separating the cantilever beam.

In implementation, two ends of the cantilever beam and the lower top face of the hook plate are correspondingly provided with lock holes, so that the lower top face of the hook plate is capable of being fixedly locked and jointed to the cantilever beam.

In implementation, the cantilever beam is further provided with a plurality of types of fixing holes with different diameters for the pipelines to be fixed thereto.

In implementation, the top portion of the foot stand and the cover are correspondingly provided with lock holes, so that the cover is capable of being fixedly locked and jointed to the top portion of the foot stand.

For further understanding the characteristics and effects of the present invention, some preferred embodiments referred to drawings are in detail described as follows.

DETAILED DESCRIPTIONS OF PREFERRED EMBODIMENTS

Please refer to FIGS. 1-4, which show an embodiment of a raised floor system for suspension type pipelines of the present invention. The system mainly comprises girders 2 and floor units 3 laid between pluralities of foot stands 1 after the foot stands 1 are erected at intervals on the floor, such that the floor units 3 are separated from the floor by a distance so as to form a large-area raised floor.

Figure 1:
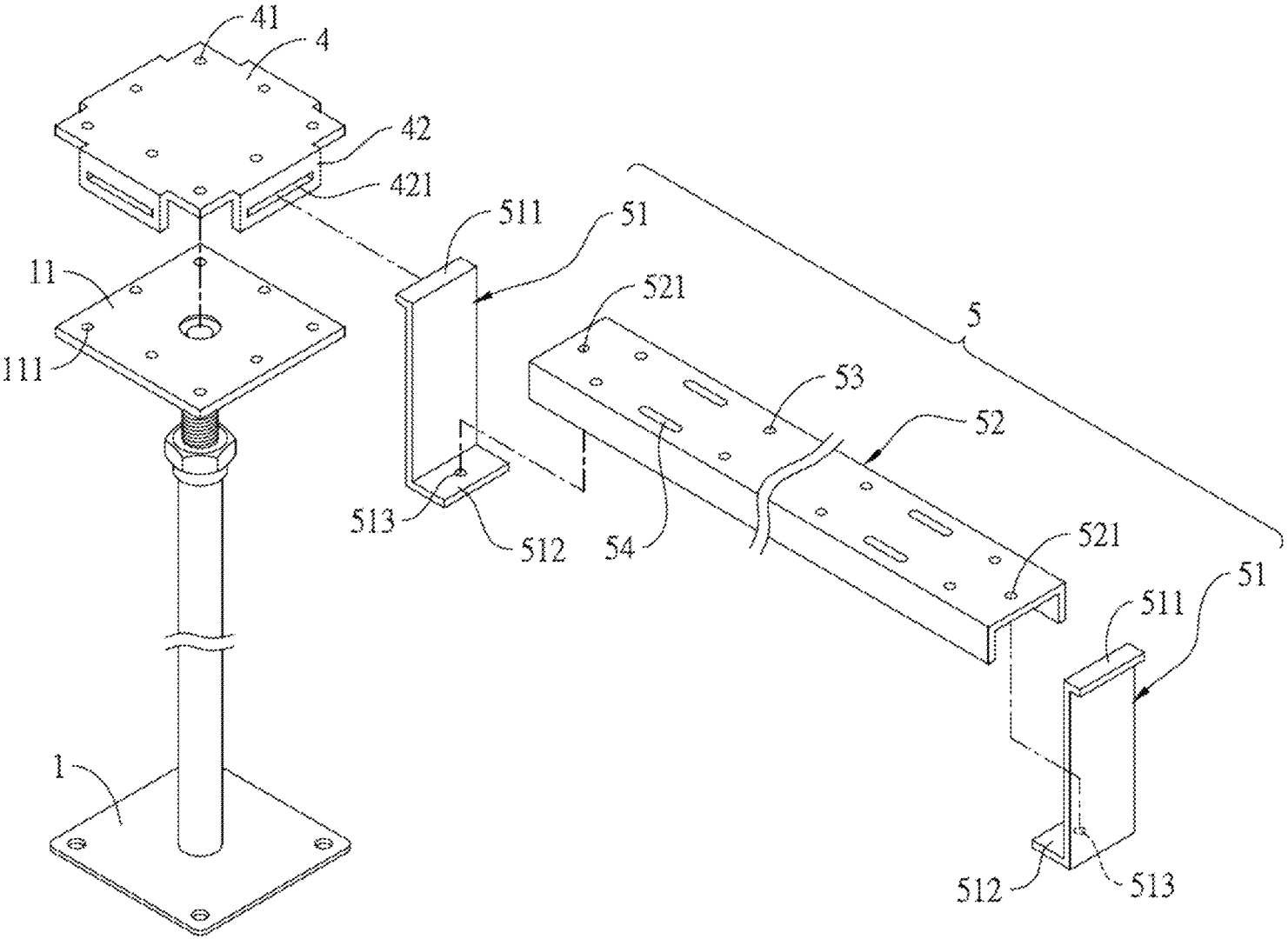
FIG. 1 is a schematic perspective view showing a cover and a suspension device of an embodiment of the present invention before assembled.
Figure 2:
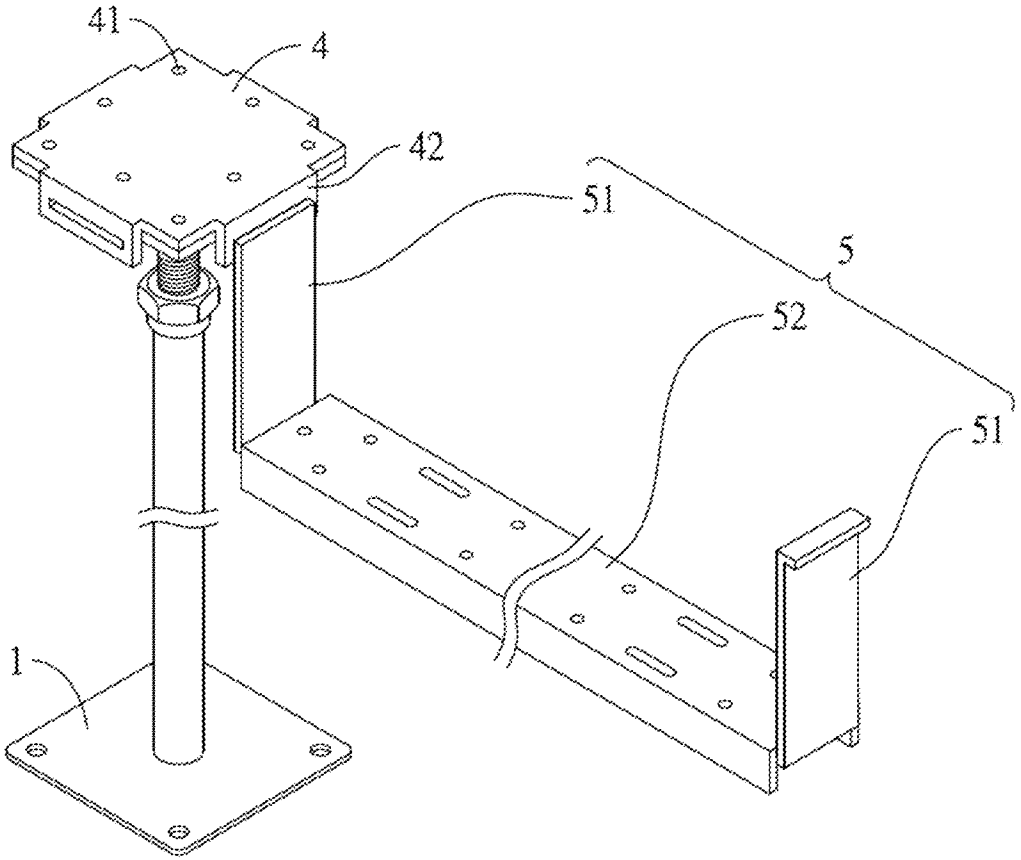
FIG. 2 is a schematic perspective view showing a foot stand, the cover and the suspension device of the embodiment of the present invention after assembled.
Figure 3:
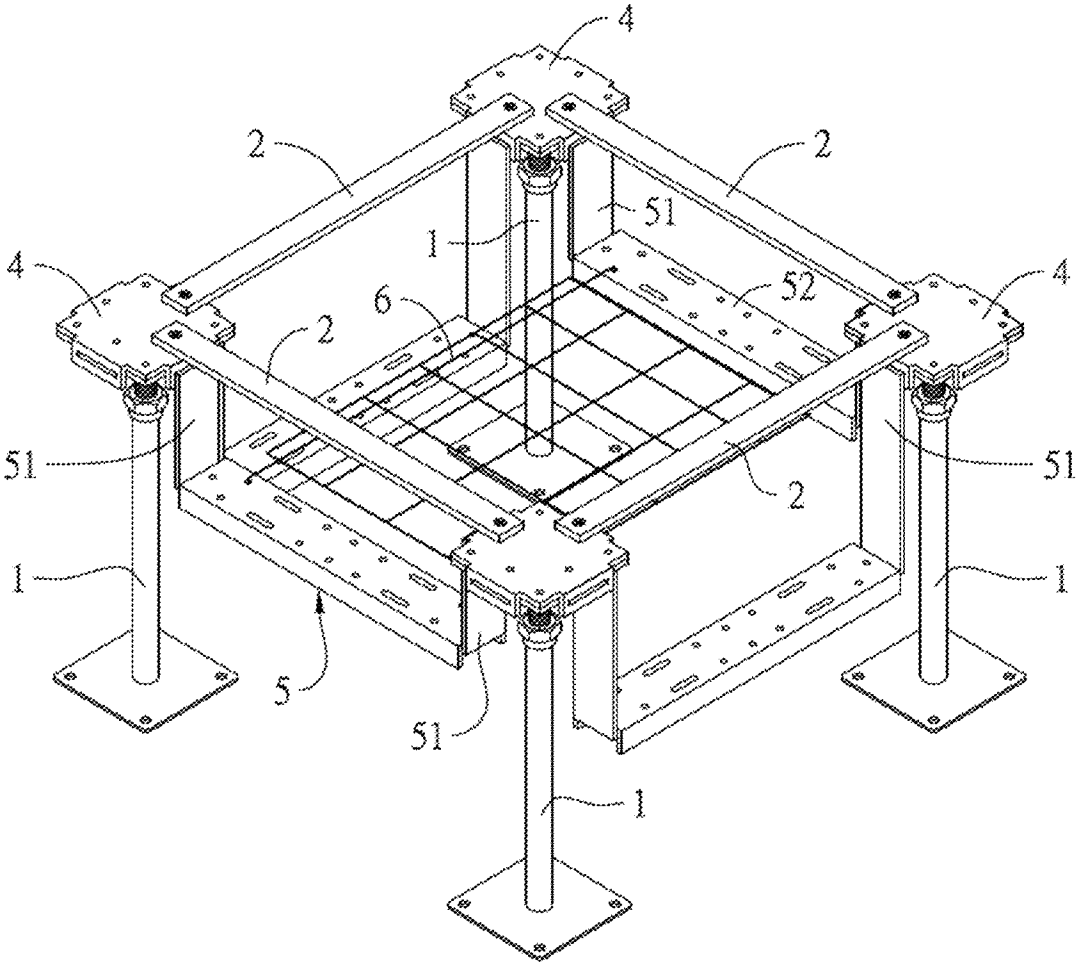
FIG. 3 is a schematic perspective view showing the suspension device of the embodiment of the present invention after assembled at different heights.

As shown in FIGS. 1 and 2, a top portion 11 of the foot stand 1 for the floor units 3 to be placed thereon is combined with a cover 4. The top portion 11 of the foot stand 1 and the cover 4 are correspondingly provided with lock holes 111, 41, such that the cover 4 is capable of being fixedly locked and jointed to the top portion 11 of the foot stand 1, and the girders 2 are also capable of being directly locked and jointed to the cover 4 (as shown in FIG. 3). Of four sides of the cover 4 each is vertically provided with a folded plate 42. A hole 421 is formed on each folded plate 42. Two ends of a suspension device 5 are capable of being respectively hooked on the holes 421 of the folded plates 42 of two spaced foot stands 1, so that the suspension device 5 is placed under the floor units 3 for pipelines to be placed thereon or fixed thereto.

In fact, as shown in FIGS. 1 and 2, the suspension device 5 comprises two hook plates 51 and an inverted U-shaped cantilever beam 52. The hook plate 51 is Z-shaped. An upper top face 511 and a lower top face 512 are formed on two ends of the hook plate 51, wherein the upper top face 511 is used for passing through the hole 421 of the folded plate 42, the lower top face 512 is used for supporting one end of the cantilever beam 52. And two ends of the cantilever beam 52 and the lower top face 512 of the hook plate 51 are correspondingly provided with lock holes 513, 521, such that after the lower top face 512 of the hook plate 51 is fixedly locked and jointed to the cantilever beam 52, the suspension device 5 is capable of being positioned between two foot stands 1 (as shown in FIG. 3).

Figure 4:
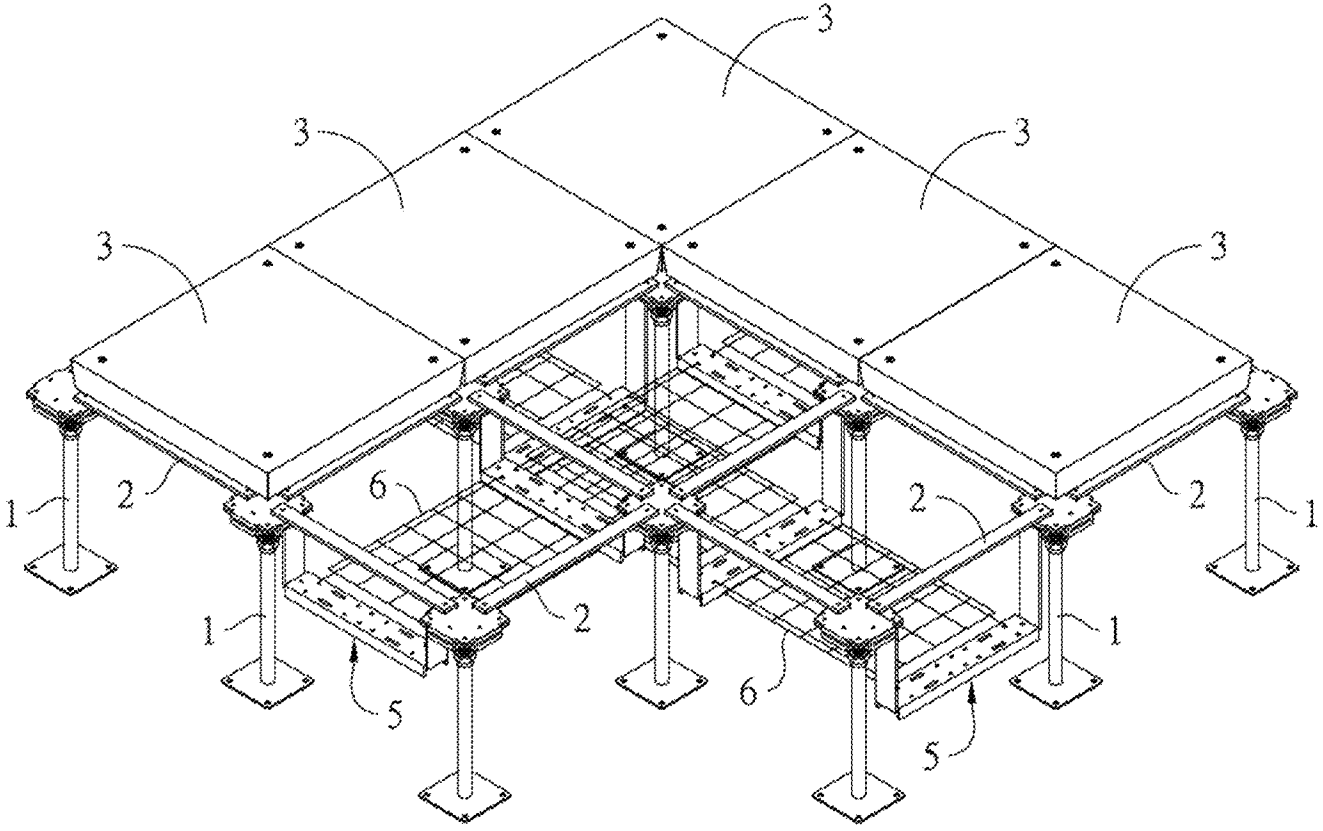
FIG. 4 is a schematic view showing an embodiment of the present invention after floor units laid.
Figure 6:
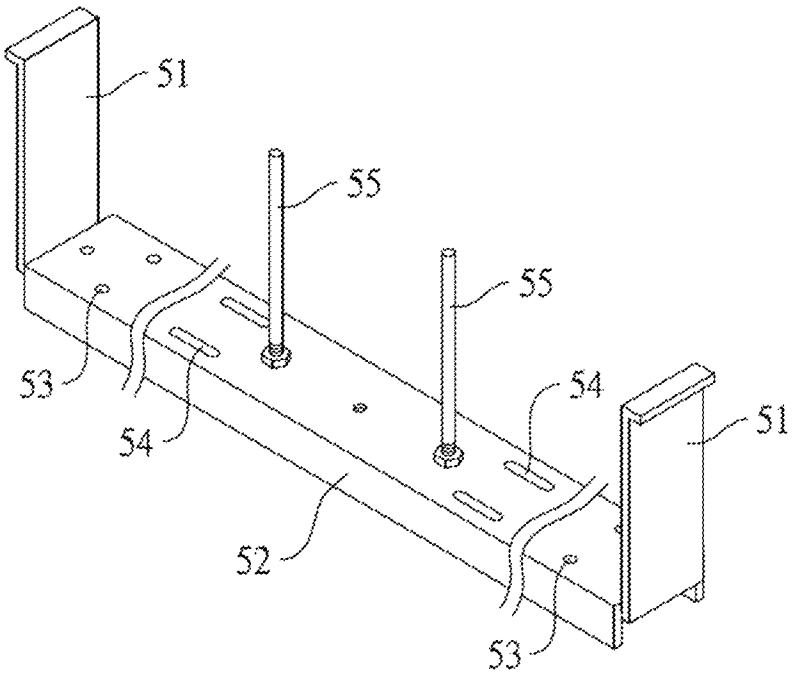
FIG. 6 is a schematic view showing a state when a cantilever beam is provided with several separation columns in an embodiment of the present invention.
Figure 5:
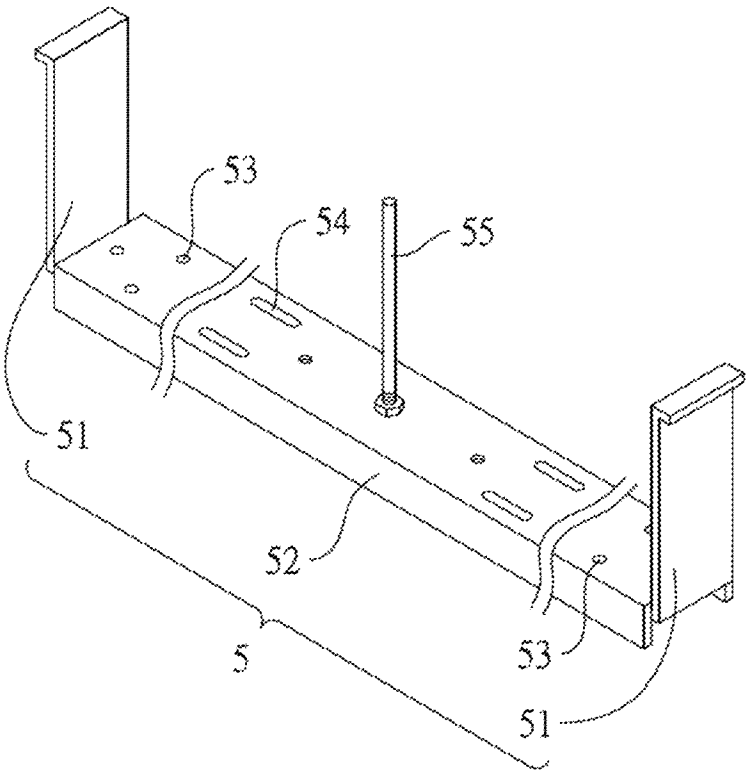
FIG. 5 is a schematic view showing a state when a cantilever beam is provided with a separation column in an embodiment of the present invention.

Furthermore, as shown in FIGS. 5 and 6, the cantilever beam 52 is further provided with a plurality of types of fixing holes 53, 54 with different diameters for the pipelines or line bottom nets 6 (as shown in FIG. 4) to be fixed thereto and hooked thereon. The cantilever beam 52 is further provided with at least one separation column 55 for separating the cantilever beam 52.

Therefore, during construction, after several foot stands 1 for the raised floor are laid on the ground, the cover 4 is capable of being fixedly locked and jointed to the top portion 11 of the foot stand 1, and the construction staff can choose the hook plates 51 with different lengths according to the needs of use, after the upper top face 511 of the hook plate 51 is passed through the hole 421 of the folded plate 42, and the lower top face 512 of the hook plate 51 and the cantilever beam 52 are fixedly locked and jointed, such that the cantilever beam 52 is suspended between two hook plates 51, the construction staff can arrange the pipelines. Finally, after the girders 2 are locked and jointed to the cover 4 and the floor units 3 are laid on the girders 2, a large-area raised floor system can be formed (as shown in FIG. 4).

In this way, through the design of the present invention, it has the advantages as follows:

1. Through the design of the folded plates around the cover on the top portion of the foot stand and the suspension device for various kinds of pipelines or line bottom nets, such as network cables, electrical wires, signal wires or water pipes, air-conditioning ducts, to be placed thereon or fixed thereto, the present invention is not only low in cost and simple in structure, but it is also more convenient for users to check and repair in order to reduce working hours and improve efficiency when replacing or maintaining pipelines in the future.
2. Through the design of the suspension device of the present invention, various kinds of pipelines are capable being directly placed on the inverted U-shaped cantilever beam or hooked on fixing holes with different diameters on the cantilever beam, and, at the same time, the hook plates with different lengths can be chosen according to actual needs to produce an effect similar to multi-player channels (as shown in FIG. 3). At the same time, it can also be matched with the design of the separation column on the cantilever beam to achieve the purpose of diverting large and small pipelines or being convenient construction.
3. Although the design of suspension of the present invention is different from the structure of all current raised floors, the components such as the foot stands, the girders and the floor units still retain the same structures as of those available on the market today. Hence, for the existing traditional raised floor industry or the places where the traditional raised floor is already in use, it can be easily upgraded to the structure of the present invention without the need to completely replace or destroy the existing structure. Not only can the effect of the present invention be achieved quickly, but also the cost and inventory can be greatly reduced, and the waste problem can be reduced, and it is also environmentally friendly.

As disclosed in the above description and attached drawings, the present invention can provide a raised floor system for suspension type pipelines. It is new and can be put into industrial use.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A raised floor system for suspension type pipelines, which comprises a plurality of girders and a plurality of floor units laid between a plurality of foot stands after the foot stands are erected at intervals on a floor, such that the floor units are separated from the floor by a distance so as to form a raised floor, wherein a top portion of each of the foot stands for the floor units to be placed thereon is combined with a cover, of four sides of each of the covers each is provided with a folded plate extending downwards, a hole is formed on each of the folded plates, two ends of a suspension device are respectively hooked on two of the holes of two of the folded plates of two of the covers on two of the top portions of two of the spaced foot stands, so that the suspension device is placed under the floor units for pipelines to be placed thereon or fixed thereto.

2. The raised floor system for suspension type pipelines according to claim 1, wherein the suspension device comprises two hook plates and an inverted U-shaped cantilever beam, each of the two hook plates is Z-shaped, an upper top face and a lower top face are formed on two ends of each of the two hook plates, wherein two of the upper top faces of the two hook plates are used for passing through two of the holes of two of the folded plates of two of the covers on two of the top portions of two of the spaced foot stands, two of the lower top faces of the two hook plates are used for supporting two ends of the inverted U-shaped cantilever beam respectively so that the suspension device is positioned between the two of the spaced foot stands.

3. The raised floor system for suspension type pipelines according to claim 2, wherein the inverted U-shaped cantilever beam is further provided with a plurality of types of fixing holes with different diameters for the pipelines to be fixed thereto.

4. The raised floor system for suspension type pipelines according to claim 2, wherein the two ends of the inverted U-shaped cantilever beam and the two of the lower top faces of the two hook plates are correspondingly provided with a plurality of lock holes respectively, so that the two of the lower top faces of the two hook plates are fixedly locked and jointed to the inverted U-shaped cantilever beam.

5. The raised floor system for suspension type pipelines according to claim 4, wherein the inverted U-shaped cantilever beam is further provided with a plurality of types of fixing holes with different diameters for the pipelines to be fixed thereto.

6. The raised floor system for suspension type pipelines according to claim 2, wherein at least one separation column is further provided on the inverted U-shaped cantilever beam.

7. The raised floor system for suspension type pipelines according to claim 6, wherein the inverted U-shaped cantilever beam is further provided with a plurality of types of fixing holes with different diameters for the pipelines to be fixed thereto.

8. The raised floor system for suspension type pipelines according to claim 1, wherein the top portion of each of the foot stands and each of the covers are correspondingly provided with a plurality lock holes respectively, so that each of the covers is fixedly locked and jointed to the top portion of each of the foot stands.

* * * * *